US008573110B2

(12) United States Patent
Jones

(10) Patent No.: US 8,573,110 B2
(45) Date of Patent: Nov. 5, 2013

(54) RPG LAUNCHER DETERRENT

(75) Inventor: Johnny Jones, Cincinnati, OH (US)

(73) Assignee: Beyond Today Solutions & Technology LLC, Cincinnati, OH (US)

( * ) Notice: Subject to any disclaimer, the term of this patent is extended or adjusted under 35 U.S.C. 154(b) by 217 days.

(21) Appl. No.: 12/455,472

(22) Filed: Jun. 2, 2009

(65) Prior Publication Data

US 2012/0175418 A1 Jul. 12, 2012

Related U.S. Application Data

(60) Provisional application No. 61/205,077, filed on Jan. 15, 2009, provisional application No. 61/215,036, filed on May 1, 2009.

(51) Int. Cl.
*F41G 3/14* (2006.01)

(52) U.S. Cl.
USPC ..... 89/41.07

(58) Field of Classification Search
USPC ..... 89/41.07; 102/425, 427
See application file for complete search history.

(56) References Cited

U.S. PATENT DOCUMENTS

| | | | | |
|---|---|---|---|---|
| 4,004,487 | A * | 1/1977 | Eichweber | 89/1.815 |
| 5,042,743 | A * | 8/1991 | Carney | 244/3.11 |
| 5,284,081 | A * | 2/1994 | Stoner et al. | 89/33.17 |
| 5,942,716 | A | 8/1999 | Miller | |
| 6,170,377 | B1 * | 1/2001 | Larsson et al. | 89/6.5 |
| 6,412,391 | B1 | 7/2002 | Stevens et al. | |
| 6,720,907 | B1 | 4/2004 | Miron | |
| 6,920,827 | B2 | 7/2005 | Llyod | |
| 6,943,873 | B2 | 9/2005 | Sallee | |
| 7,021,187 | B1 * | 4/2006 | Grassi | 89/6.5 |
| 7,190,304 | B1 | 3/2007 | Carlson | |
| 7,202,809 | B1 | 4/2007 | Schade et al. | |
| 7,348,918 | B2 * | 3/2008 | Redano | 342/62 |
| 7,451,704 | B1 | 11/2008 | Gold et al. | |
| 7,490,430 | B2 * | 2/2009 | Staley, III | 42/111 |
| 2006/0021498 | A1 | 2/2006 | Moroz et al. | |
| 2006/0283317 | A1 | 12/2006 | Melnychuk et al. | |
| 2007/0125951 | A1 | 6/2007 | Snider et al. | |
| 2007/0180983 | A1 | 8/2007 | Farinella et al. | |
| 2008/0018519 | A1 * | 1/2008 | Berg et al. | 342/14 |

OTHER PUBLICATIONS

Active Protection System for AFVs, Rafael Advanced Defense Systems Ltd., http://www.rafael.co.il.marketing/homepage.aspx?FolderID=281&docID=963&searchText=trophy, printed Jan. 28, 2010, one page.

(Continued)

*Primary Examiner* — Stephen M Johnson
(74) *Attorney, Agent, or Firm* — Frost Brown Todd LLC

(57) ABSTRACT

A counter offensive weapon system is provided for use on a vehicle to fire upon and neutralize those launching projectiles, including RPG's, at the vehicle. A muzzle flash detected by an on-board monitoring device allows the distance and direction to the projectile launch site to be calculated so that an offensive weapon may be immediately deployed to the projectile launch site to neutralize the enemy weapon and shooter. An air burst munition is programmed to detonate just prior to reaching the measured distance to create a conical dispersion of fragments that are effective at destroying weapons such as RPG tubes. A related method for protecting a vehicle and launching counter offensive weapons is also provided.

14 Claims, 3 Drawing Sheets

(56) References Cited

OTHER PUBLICATIONS

ASPRO-A (Trophy), Active Protection System for Armored Fighting Vehicles, Rafael Advanced Defense Systems Ltd., pp. 1-2, available at http://www.rafael.co.il/marketing/homepage.aspx?FolderID=281&docID=963&searchText=trophy, printed Jan. 28, 2010.

No Trophy for NBC News, Defense Tech, http://defensetech.org/2006/09/07/no-trophy-for-nbc-nes, printed Jan. 28, 2010, two pages.

PGU-14/B API Armor piercing incendiary [DU] 30mm Ammunition, FAS Military Analysis Network, http://www.fas.org/man/dod-101/sys/land/pgu-14.htm, printed Apr. 20, 2009, 2 pages.

RPG-7/RPG-7V/RPG-7VR Rocket Propelled Grenade Launcher (Multi Purpose Weapon), Defense Update (Jul. 27, 2006), http://www.defense-update.com/products/r/rpg.htm, printed Nov. 10, 2009, two pages.

Staballoy, Answers.com, http://www.answers.com/topic/staballoy?&print=true, printed Jan. 28, 2010, two pages.

30mm Cannon Ammunition, FAS Military Analysis Network, http://www.fas.org/man/dod-101/sys/land/30mm.htm, printed Apr. 20, 2009, two pages.

M1131 Stryker FSV—Fire Suppot Vehicle, Global Security.Org, http://www.globalsecurity.org/military/systems/ground/iav-fsv.htm., printed Apr. 14, 2010, one page.

International Search Report and Written Opinion dated Aug. 25, 2010 for Application No. PCT/US2010/21108.

* cited by examiner

RPG LAUNCHER DETERRENT

PRIORITY CLAIM

This application claims priority to U.S. Provisional Application Ser. No. 61/205,077, filed Jan. 15, 2009, entitled RPG LAUNCHER DETERRENT, and to U.S. Provisional Application Ser. No. 61/215,036, filed May 1, 2009, entitled RPG LAUNCHER DETERRENT, the disclosures of which are hereby incorporated by reference in their entirety.

FIELD OF THE INVENTION

This invention relates to a vehicle mounted, fast acting vehicle mounted counter offensive weapon system that returns fire accurately to neutralize a weapon launching an RPG upon the vehicle and the shooter firing the weapon.

BACKGROUND OF THE INVENTION

In military operations, troops and equipment are continually subject to ambush and attack from all directions, including those utilizing hand held weapons and concealing themselves.

Perhaps the biggest threats facing military vehicles today are Rocket Propelled Grenades (RPG's) that are fast moving, highly explosive and damaging projectiles which can easily be fired on a tank or military vehicle from a single enemy combatant's shoulder. RPG's are extremely dangerous because they are so portable, but still are very damaging to even the most heavily armored tank or truck, and are fast moving enough that they cannot be manually neutralized.

In light of the dangers presented by RPG's, as well as other projectiles that may be fired upon military vehicles, there is clearly a need to equip military vehicles with a defense device to engage and destroy any projectile coming at the vehicle. There are, in fact, a number of such defense devices and mechanisms known in the prior art. Generally, such defense devices comprise military vehicles equipped with incoming projection recognition means and a countermeasure that is launched to engage the incoming projectile prior to impacting the vehicle. Various defensive vehicle protection systems are disclosed in U.S. Pat. Nos. 7,202,809; 6,720,907; and U.S. Patent Applications US2004/0056792 and US2007/0180983. In each disclosure, the defensive vehicle protection system detects a projectile and calculates its path and impact, calculates an intercept point for the incoming projectile, and launches a countermeasure to intercept the incoming projectile. All of those actions must be done with great speed and precision to defeat an incoming projectile. It is also necessary that the defensive vehicle protection system have the capability to detect and intercept multiple incoming projectiles from different locations, requiring the need to select the most immediate threat and launch countermeasures in response to the multiple incoming threats.

To carry out this purpose, the defensive vehicle protection system must first be able to detect when a valid launch has occurred and distinguish the firing of a weapon from other flashes of light or heat. This is typically done by looking at the detected thermal signature characteristics of a suspected weapon launch, for example heat intensity/temperature and size of the flash, and then comparing the detected thermal signature characteristics to stored data for various weapons, including an RPG launcher. Next, the verification is confirmed by the presence of an incoming projectile from the direction of the suspected weapon launch.

Prior art devices and systems utilizing such weapon launch detection do not, however, take subsequent steps after detection of incoming projectiles to precisely determine the launch point and/or fire an offensive weapon to neutralize the weapon (such as an RPG launcher) or the shooter. The disadvantage of not immediately firing back is that another projectile can be launched from the weapon and, if the countermeasure has not had time to be reset and reloaded, or if the weapon has been moved to a different vantage point, the vehicle and all of its occupants are left vulnerable. Insofar as the weapon being fired is the primary threat, it is most advantageous to use a system and munition that is directed to eliminating the weapon first and the shooter second.

The present invention is thus directed to a counter offensive weapon system for eliminating a weapon, such as an RPG launcher, that fires upon a vehicle, and the shooter of the weapon, by utilizing information gathered by a defensive vehicle protection system after detection of an incoming projectile. As set forth in more detail herein, the counter offensive weapon system of the present invention utilizes some data acquired by a vehicle defense system, and then calculates the precise position of the weapon and shooter and fires an offensive weapon back at the weapon and shooter to neutralize them. An accurate air burst munition is programmed to detonate just before reaching the weapon and shooter to create a dispersed blast with the highest likelihood of eliminating the weapon.

OBJECTS OF THE INVENTION

It is an object of the present invention to provide a counter offensive weapon system on a vehicle that neutralizes an attack by firing back in the direction and distance that a projectile was launched at the vehicle.

It is another object of the present invention to provide a counter offensive weapon system that cooperates with a vehicle defense system to detect projectiles launched at the vehicle, and to neutralize the weapon and shooter launching such projectiles.

It is yet another object of the present invention to provide a vehicle defense system and counter offensive weapon system that neutralizes those attacking equipped vehicles by utilizing munitions intended primarily to eliminate an enemy combatant's weapon.

It is a further object of the present invention to provide a counter offensive weapon system utilizing programmable air burst munitions.

It is yet another object of the present invention to provide a counter offensive weapon system that can, in coordination with a defensive vehicle protection system, detect and eliminate multiple enemy combatant weapons and shooters and shooters firing upon a vehicle.

These and other objects and advantages of the present invention will be apparent from a review of the following specification and accompanying drawings.

SUMMARY OF THE INVENTION

The present invention provides a counter offensive weapon system mounted on a vehicle having a laser range finder, a munitions firing tube, programmable munitions and a communications link to an on-board vehicle defense system for receiving position data for a launch of an incoming projectile that was fired upon the vehicle. The laser range finder calculates a distance to the launch point of the incoming projectile and launches the programmable munition at the launch point to neutralize the weapon and shooter at the launch point.

In another embodiment, a combination vehicle protection system and counter offensive weapon system is provided. A monitoring device is provided that detects and verifies suspected projectile launches and incoming projectiles. Means for calculating the speed, travel path and estimated time of the arrival of the incoming projectile to strike the vehicle, and means for calculating a ballistic solution to intercept an incoming projectile and means for launching a countermeasure to engage and destroy an incoming projectile are all provided as part of a vehicle protection system. A communication link from the vehicle protection system is provided to an on-board counter offensive weapon system. A laser range finder, a munitions firing tube, and programmable munitions are all provided as components of a counter offensive weapon system. The laser range finder calculates a distance to the launch point of the incoming projectile, utilizing data relating to the detected flash position, and launches a programmable munition at the launch point. The programmable munition in the most preferred embodiment is an air burst munition that detonates just prior to reaching the launch point to create a fragmentary dispersion that is particularly effective at eliminating an enemy combatant weapon, such as an RPG launcher.

A related method for protecting a vehicle and launching counter offensive weapons is also provided. The inventive method comprises multiple steps including first detecting a flash of light or heat indicating a rocket blast and narrowing the monitored range where the flash was detected. Next, the thermal signature characteristics of the detected flash of light or heat is compressed to data for known weapons to confirm whether the flash was, in fact, a rocket blast. Finally, an incoming projectile is detected and the trajectory calculated.

The next steps in the inventive method is scheduling the launch of a countermeasure to engage an incoming projectile at an intercept point, and then launching the countermeasure. Next, the distance to the rocket blast location is measured, and the air burst munition is programmed to detonate just short of the measured distance to the launch position to create a desirable fragment dispersion to increase the likelihood of eliminating the weapon. Finally, the air burst munitions are deployed to the launch site and detonate just prior to reaching the launch site to create the desired fragment dispersion.

DETAILED DESCRIPTION OF THE INVENTION

Figure 1:
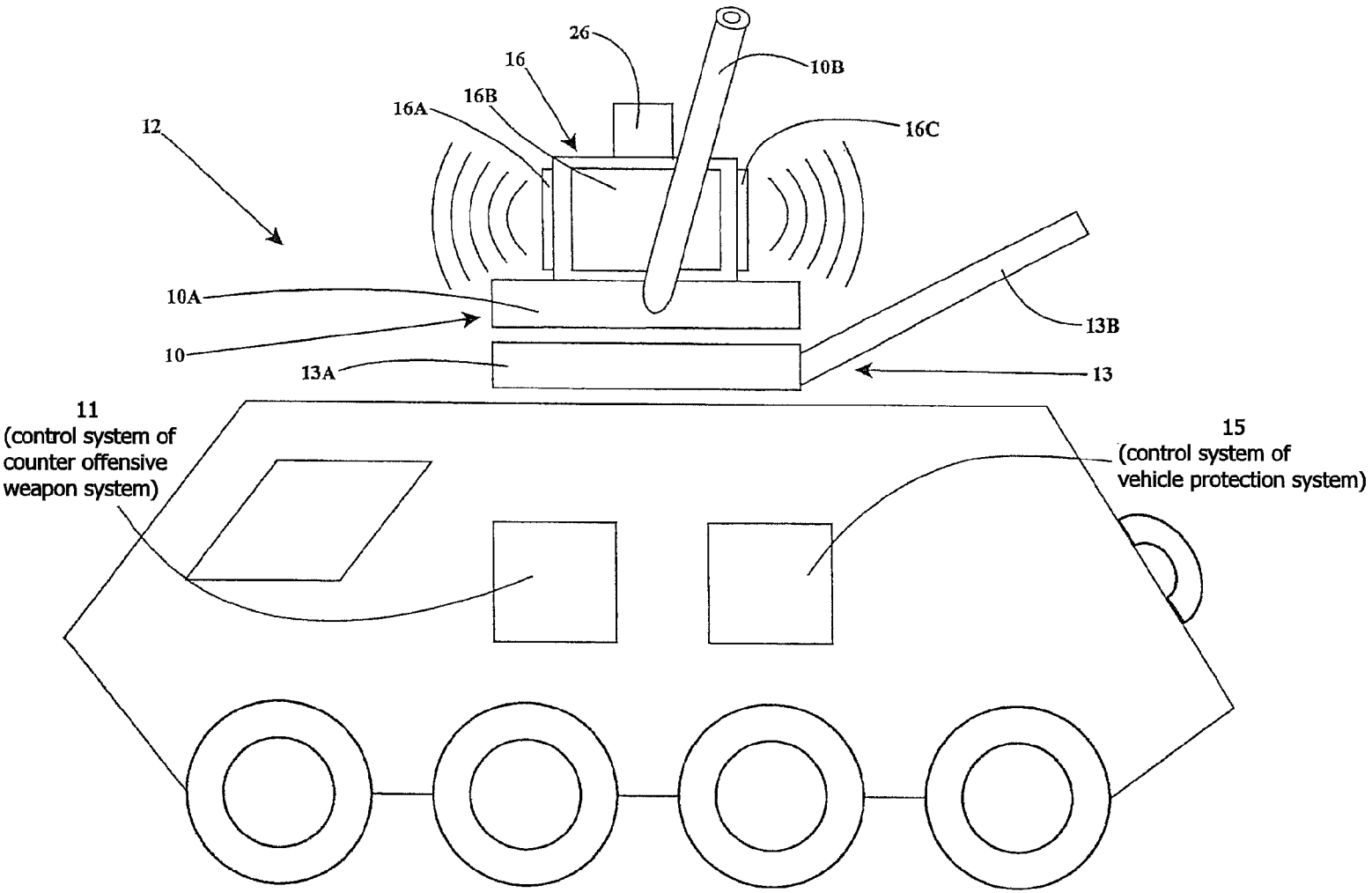
FIG. 1 is a representation of the primary components of the counter offensive weapon system of the present invention and its operation and the coordination and communication with the on-board vehicle protection system.
Figure 2:
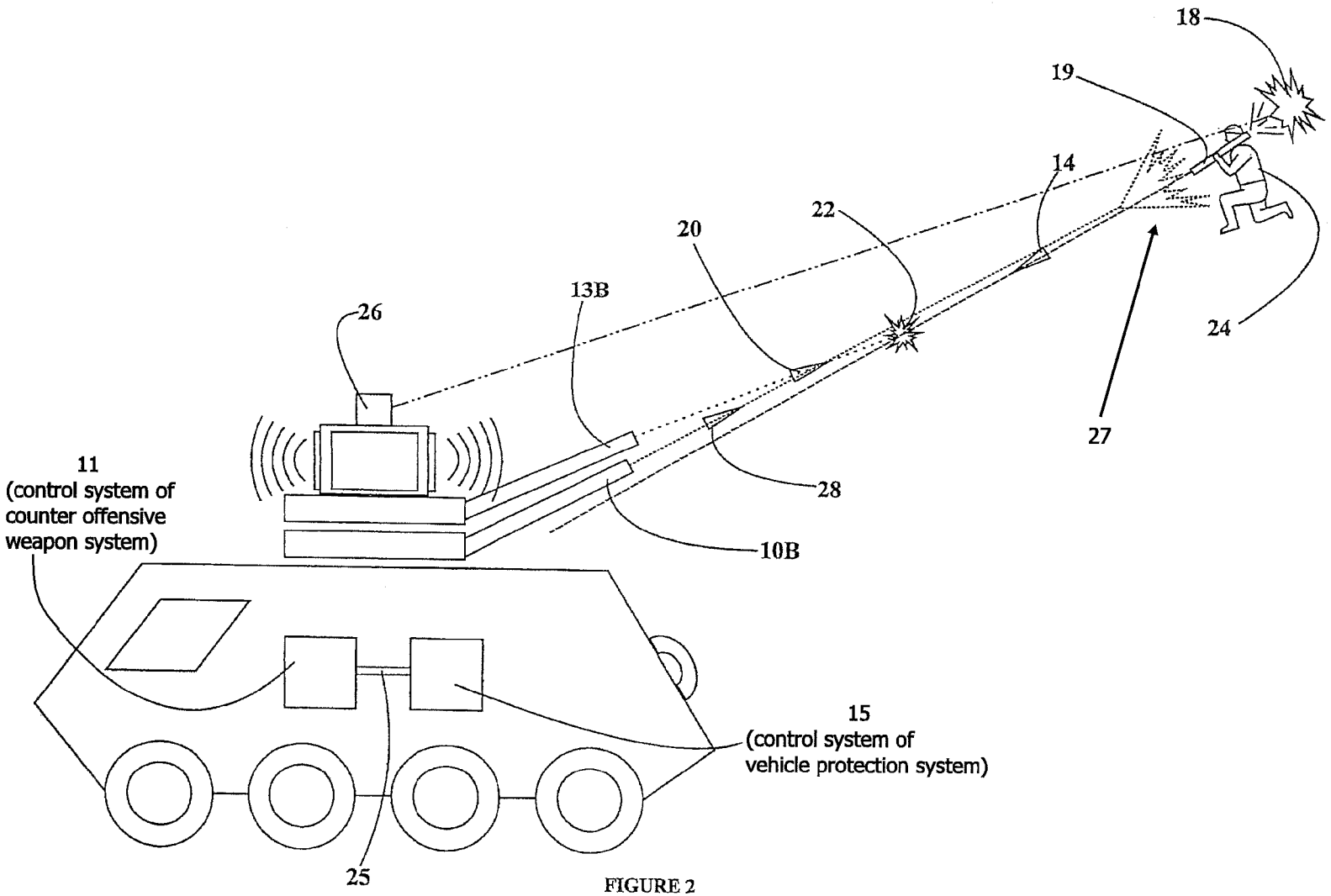
FIG. 2 is a schematic representation of the vehicle utilizing a counter offensive weapon system and defensive vehicle protection system to detect and eliminate an incoming projectile and to detect and eliminate an enemy combatant weapon and shooter.
Figure 3:
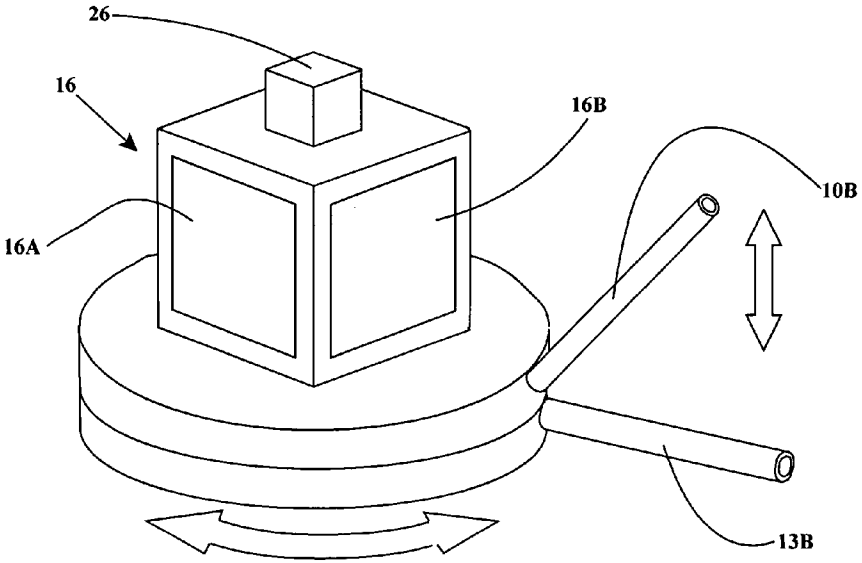
FIG. 3 is a perspective view of stacked dual rotating guns designed to deploy an RPG countermeasure and to fire a neutralization round at the RPG launch site.
Figure 5:
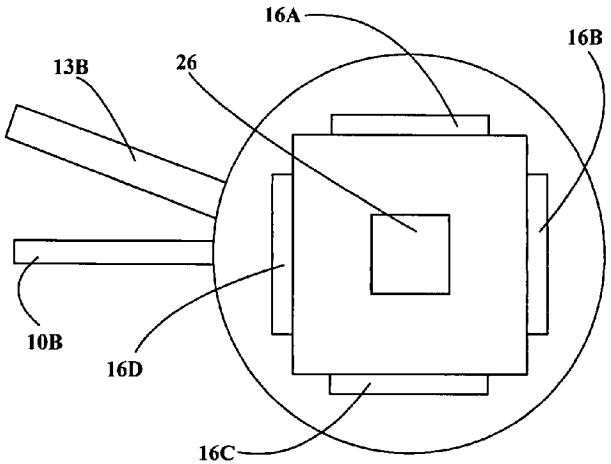
FIG. 5 is a top view of stacked dual rotating guns designed to deploy an RPG countermeasure and to fire a neutralization round at the RPG launch site.
Figure 4:
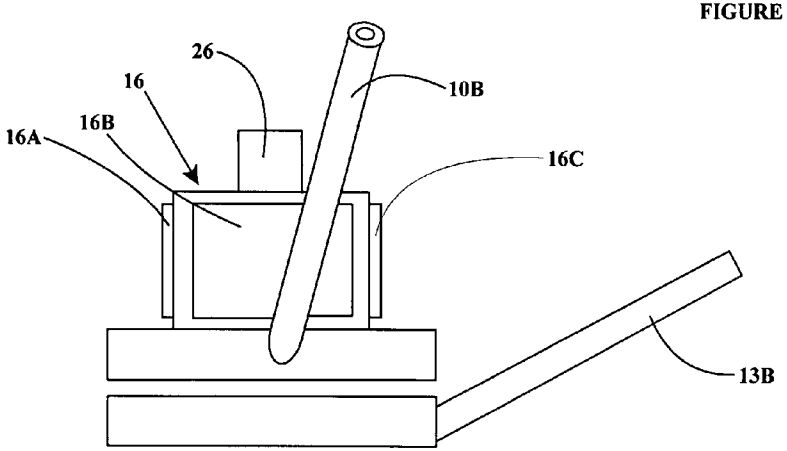
FIG. 4 is a side view of stacked dual rotating guns designed to deploy an RPG countermeasure and to fire a neutralization round at the RPG launch site.

The present invention is a counter offensive weapon system comprising a rotary offensive gun 10 and a control system 11 therefor mounted on a vehicle 12. In the most preferred embodiment of the present invention, the vehicle 12 includes an on-board vehicle protection system comprising a rotary countermeasure gun 13 and control system 15 therefor that detects launches of incoming projectiles 14 and deploys countermeasures to intercept and defeat the incoming projectile 14.

The vehicle 12 is equipped with a full 360 degree monitoring device 16 that is continually looking at the area surrounding the vehicle 12 to detect any launch of a projectile 14 toward the vehicle 12. In the most preferred embodiment of the present invention, this monitoring device 16 is a radar system having four panels 16A, 16B, 16C, 16D, although other monitoring devices such as thermal imaging, infrared, video, or any other device that monitors an area and detects incoming projectiles or flash events is contemplated such that their use does not depart from the principles of the present invention.

When the monitoring device 16 detects an apparent flash 18 of light or heat preliminarily indicating a weapon discharge, the control system 15 of the vehicle protection system then compares the thermal signature characteristics of the detected flash 18 to stored data relating to thermal signatures of known weapons, including RPG launchers, to verify whether the flash 18 was, in fact, a weapon launch. Examples of thermal signature characteristics considered include heat intensity/temperature, and the diameter of the detected flash. Once it has been confirmed that the flash 18 was a weapon launch from a remote enemy combatant weapon 19, the monitoring device 16 narrows its focus and begins looking for an incoming projectile 14 in a small sector of space based upon where the flash 18 was detected. Once the incoming projectile 14 has been positively detected, the vehicle protection system 13 calculates the speed of the incoming projectile 14 and travel path and time of arrival for the projectile 14 to strike the vehicle 12.

In the most preferred embodiment of the present invention, the rotary offensive gun 10 comprises a 360 degree rotating base 10A and a vertically adjustable barrel 10B, and the rotary countermeasure gun 13 comprises a 360 degree rotating base 13A and a vertically adjustable tube 13B. Other arrangements for similar 360 degree viewing, vertically adjustable gun devices are contemplated by the principles of the present invention such that their use is not patentably distinguishable.

After determining the speed, position and time at which the incoming projectile 14 will strike the vehicle 12, the vehicle protection control system 15 calculates a ballistic solution, rotates and elevates the tube 13B and launches a countermeasure 20 from the tube 13B to engage and destroy the incoming projectile 14 at an intercept point 22. The vehicle protection control system 15 then communicates relevant data to the counter offensive weapon control system 11 via data link 25. Next, utilizing data from the vehicle protection control system 15, the counter offensive weapon control system 11 first calculates the precise distances to the launch point and shooter 24 utilizing a laser range finder 26.

The laser range finder 26 is trained on the detected location of the flash 18, received from the vehicle protection control system 15, and calculates the precise distance to the launcher 19 and shooter 24.

Once the distance to the launcher 19 and shooter 24 is calculated, a programmable air burst munition 28 is programmed, the rotary offensive gun 10 is rotated and its barrel 10B elevated, and the air burst munition 28 is launched from the barrel 10B. The air burst munition 28 has a very well defined and contained detonation solution so that, if the distance to the desired detonation point is known, in this case the position of the launcher 19 and shooter 24 ($x_2$ $y_2$ $z_2$), a very efficient strike is carried out wherein the air burst munition 28 detonates to create a conical fragmentary dispersion 27 just before reaching the launcher 19 and shooter 24. It is the primary focus of the counter offensive weapon system to eliminate the launcher 19 and a fragmenting munition 28, such as an air burst munition 28 is highly desirable because of the damage its dispersed fragments will do to the launcher 19.

Just as with the vehicle protection control system 15, the counter offensive weapon control system 11 responds very quickly when an incoming projectile 14 is detected. Typically, from the time that the incoming projectile 14 is detected to the time that the launcher 19 is eliminated, a total of only 2-3 seconds has elapsed.

In addition to the apparatus set forth above, a method for offensive protection of a vehicle is also provided. In the first step of the method, a vehicle 12 is provided having both a vehicle protection control system 15 and rotating countermeasure gun 13 and a counter offensive weapon control system 11 and rotating offensive gun 10 on-board that operate cooperatively. The next step in the present method is detecting a flash 18 event that preliminarily indicates a weapon has been discharged in the vicinity of the vehicle 12. The vehicle protection control system 15 is programmed to analyze the detected flash 18 and, using known parameters such as the thermal signature of an RPG launch, the temperature of the detected flash and the size of the flash, distinguish whether the detected event was, in fact, a weapon being discharged.

The next step in the present method is for the on-board monitoring device 16 to narrow the area monitored to focus on that area in which the flash 18 was detected.

Having narrowed the area it is monitoring, the monitoring device 16 then looks for an incoming projectile in the limited monitoring area. If an incoming projectile 14 is detected, the next step is to calculate the incoming projectile position, trajectory and estimated time of arrival.

Next, the on-board vehicle protection control system 15 calculates and schedules the launch of countermeasures 20 to engage the incoming projectile 14 at an intercept point 22.

Having eliminated the immediate threat of the incoming projectile 14, the next step in the present method is to turn on the laser range finder 26 that communicates with the counter offensive weapon control system 11. The laser range finder 26 then determines the distance to the launch point weapon 19 and shooter 24, utilizing the position of the weapon 19 and shooter 24 ($x_2$ $y_2$ $z_2$) provided by the vehicle protection control system 15.

The next step in the present method is to program and load a programmable air burst munition 28 in the rotating offensive gun 10. The air burst munition 28 may be of many different types, but it will be adjustable to detonate at a specific distance. Once the air burst munition 28 is programmed, it is then loaded into the counter offensive weapon system 10 and launched toward the weapon 19 and shooter 24.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A combination vehicle defensive and offensive weapon system comprising:

(a) a monitoring device detecting a suspected projectile launch and an incoming projectile;

(b) an on-board vehicle protection system that calculates the speed, travel path and estimated time of the arrival of the incoming projectile to strike the vehicle, the vehicle protection system further calculates a ballistic solution to intercept the incoming projectile, the vehicle protection system being configured to launch a counter measure to engage and destroy the incoming projectile;

(c) an on-board counter offensive weapon system comprising:

(i) a laser range finder, (ii) a munitions firing tube, and (iii) a programmable munition; and (d) a communication link from the vehicle protection system to the counter offensive weapon system, wherein the communication link transmits a launch point defined by the position data for a launch of an incoming projectile that was fired upon the vehicle;

wherein the laser ranger finder calculates a distance to the launch point of the incoming projectile; and wherein the programmable munition is fired at the launch point.

2. The combination vehicle defensive and offensive weapon system of claim 1, wherein the vehicle protection system determines the launch point for the incoming projectile.

3. The combination vehicle defensive and offensive weapon system of claim 1, wherein the vehicle protection system and the counter offensive weapon system are operated and controlled independent from one another with the exception of the shared launch point information.

4. The combination vehicle defensive and offensive weapon system of claim 1, wherein the vehicle protection system comprises a firing weapon independent from the counter offensive weapon system munitions firing tube, wherein the firing weapon of the vehicle protection system is used to intercept the incoming projectile, and wherein the munitions firing tube of the counter offensive weapon system is used to fire the programmable munition on the launch point for the incoming projectile.

5. The combination vehicle defensive and offensive weapon system of claim 4, wherein the vehicle protection system and the counter offensive weapon system each comprise a rotary gun.

6. The combination vehicle defensive and offensive weapon system of claim 5, wherein the rotary guns are in a stacked arrangement.

7. The combination vehicle defensive and offensive weapon system of claim 1, wherein the programmable munition is an air burst munition.

8. The combination vehicle defensive and offensive weapon system of claim 1, wherein the programmable munition is programmed to detonate just prior to reaching the launch point.

9. The combination vehicle defensive and offensive weapon system of claim 1, comprising multiple programmable munitions configured to be fired at the launch point.

10. The combination vehicle defensive and offensive weapon system of claim 1, wherein the programmable munition is fired automatically.

11. A method for protecting a vehicle and launching counter offensive weapons comprising the steps of:

(a) providing a monitoring device for detecting a muzzle flash indicating a launch point for an incoming projectile fired upon the vehicle;

(b) providing a vehicle protection system that:

(i) calculates the speed, travel path and estimated time of the arrival of the incoming projectile to strike the vehicle, (ii) calculates a ballistic solution to intercept the incoming projectile, (iii) launches a counter measure to engage and destroy the incoming projectile;

(c) providing a counter offensive weapon system comprising a laser range finder, a munitions firing tube, and a programmable munition, wherein the laser range finder calculates a distance to the launch point of the incoming projectile, wherein the programmable munition is fired at the launch point; and (d) providing a communication link from the vehicle protection system to the counter offensive weapon system wherein the communications link transmits position data for the launch point of the incoming projectile that was fired upon the vehicle from the vehicle protection system to the counter offensive weapon system.

12. The method of claim 11, wherein the counter offensive weapon system receives the launch point of the incoming projectile and automatically calculates the distance to the launch point, programs the programmable munition, and fires the programmable munition at the launch point.

13. The method of claim 11, wherein the counter offensive weapon system comprises multiple programmable munitions.

14. The method of claim 13, wherein three programmable munitions are fired at the launch point.

* * * * *